United States Patent [19]

Suzuki et al.

[11] Patent Number: 4,499,123

[45] Date of Patent: Feb. 12, 1985

[54] PROCESS FOR COATING ALUMINUM WITH ZINC

[75] Inventors: Masamichi Suzuki, Mishima; Atsushi Sugihara, Shimizu; Tadaaki Sano, Fuji; Toshihiro Suzuki, Numazu, all of Japan

[73] Assignee: Alcan International Limited, Montreal, Canada

[21] Appl. No.: 491,022

[22] Filed: May 3, 1983

[51] Int. Cl.[3] ..... B05D 5/00

[52] U.S. Cl. ..... 427/282; 148/6.27; 427/328; 427/376.8; 427/436; 427/406; 427/287

[58] Field of Search ..... 427/436, 328, 287, 376.8, 427/406; 148/6.27

[56] References Cited

U.S. PATENT DOCUMENTS 3,216,835 11/1965 Saubestre ..... 427/436

3,235,404 2/1966 Mickelson et al. ..... 427/436

3,329,522 7/1967 Saubestre et al. ..... 148/6.27

3,982,055 9/1976 Howard ..... 427/436

*Primary Examiner*—Norman Morgenstern

*Assistant Examiner*—Janyce A. Bell

*Attorney, Agent, or Firm*—Cooper, Dunham, Clark, Griffin & Moran

[57] ABSTRACT

A two-step process for coating a surface of an aluminum article with zinc, wherein the surface is initially exposed to a zincate bath under relatively weak zinc-depositing conditions, and then further exposed to a zincate bath under stronger zinc-depositing conditions (lower ZnO concentration and/or higher temperature), to establish thereon an adherent coating of metallic zinc. The coated article may be heated to effect diffusion of the zinc into the aluminum for producing a zinc-enriched region adjacent the surface to protect the surface against corrosion.

17 Claims, 1 Drawing Figure

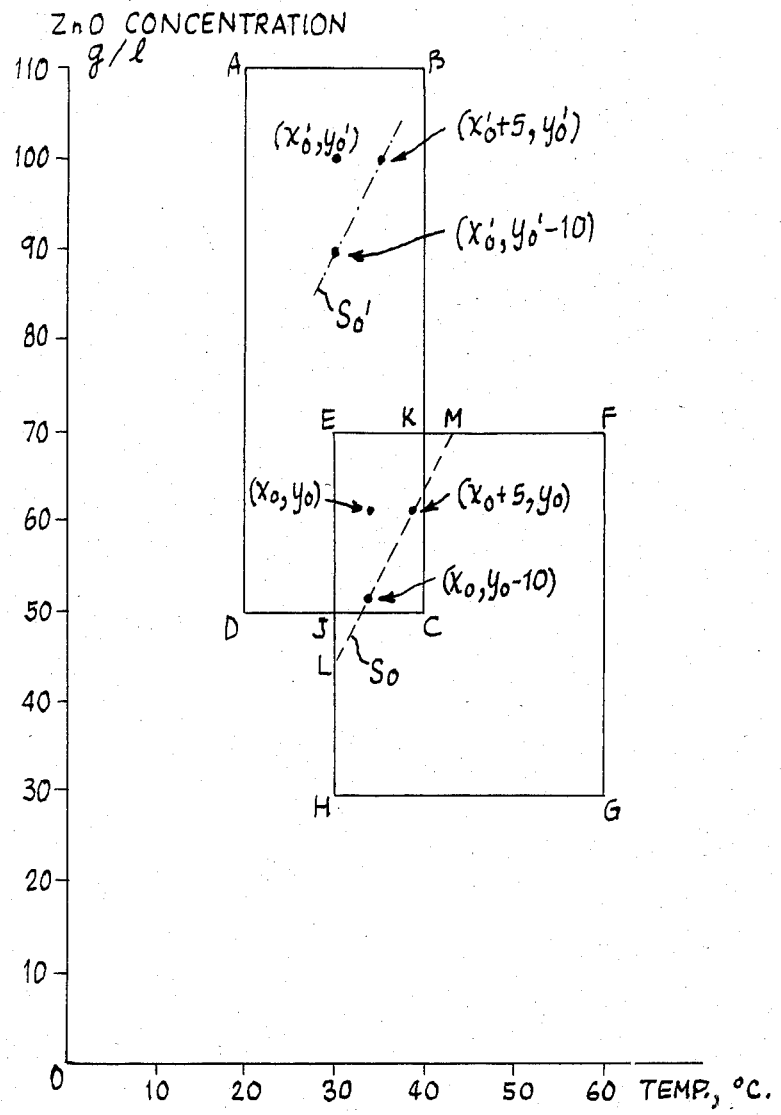
ZnO CONCENTRATION
g/l
110
100
90
80
70
60
50
40
30
20
10
0
10
20
30
40
50
60
TEMP., °C.
A
B
C
D
E
F
G
H
J
K
L
M
(x'o, y'o)
(x'o+5, y'o)
(x'o, y'o-10)
So'
(xo, yo)
(xo+5, yo)
(xo, yo-10)
So

PROCESS FOR COATING ALUMINUM WITH ZINC

BACKGROUND OF THE INVENTION

This invention relates to procedures for coating aluminum with zinc, and more particularly to so-called zincating procedures for coating aluminum. In a specific sense, it is directed to procedures for coating an aluminum article surface with an adherent layer of zinc that diffuses into the aluminum, when heated, to provide a zinc-enriched layer adjacent the surface for protecting the article against corrosion. The term "aluminum" is used herein to embrace pure metallic aluminum and alloys thereof.

An illustrative application of the present procedures, to which, however, the invention in its broader aspects is not limited, is in the production of brazed aluminum heat exchanger assemblies for use in automobiles or the like. For instance, such assemblies may comprise tubes of the aluminum alloy having the Aluminum Association designation AA 1050 and fins of the aluminum alloy having the Aluminum Association designation AA 3003, joined by brazing, i.e. by heating to a temperature below their melting points in the presence of a brazing alloy of lower melting point and a suitable flux, e.g. as described in U.S. Pat. No. 3,951,328.

Although aluminum alloys have generally satisfactory and even superior properties for use in the aforementioned assemblies, under severe conditions they are sometimes susceptible to pitting corrosion which can shorten the useful lifetime of the affected parts. Thus, in highly corrosive environments, AA 1050 alloy tubes may undergo extensive pitting and consequent early failure.

As described in U.S. Pat. No. 3,268,358, corrosion protection of an aluminum article can be achieved by coating its exposed surface or surfaces with a deposit of metallic zinc and then heating the article (to a temperature below its melting point) so as to cause the zinc to diffuse into a surface-adjacent layer of the aluminum. The resultant zinc-enriched layer, which is anodic to the essentially zinc-free underlying metal, functions sacrificially to protect the article against corrosion. In the case of a brazed assembly as referred to above, the heat of the brazing operation itself can serve to effect the requisite diffusion, provided that the component or components to be protected are adequately coated with zinc prior to brazing; but the attainment of a satisfactory zinc coating has heretofore presented difficulties.

It is known (as described at pp. 630–31 of vol. 2 of the *Metals Handbook,* 8th Edition, American Society for Metals, 1964) to apply zinc to an aluminum surface by a so-called zincating treatment, wherein (ordinarily after activation of the surface as with a dilute aqueous NaOH solution and/or with an acid bath treatment) the surface is exposed to an alkaline zincate solution. A conventional zincating procedure employs an aqueous solution containing 100 grams of zinc oxide per liter and 500 grams of sodium hydroxide per liter, at a temperature of 20° C. or less. The hydroxide (as at present believed) removes aluminum oxide initially present on the aluminum surface, and deposit of zinc on the surface proceeds by chemical displacement, aluminum ions replacing zinc ions in the solution. At the outset, in such conventional procedures, zinc deposition may be relatively rapid, but usually within a period of not more than about a minute, when the amount of zinc deposited is typically not more than about one gram per square meter, the rate of deposition becomes extremely slow and the process is ordinarily terminated.

Zincating treatments of the described conventional type are used to prepare aluminum surfaces for subsequent electroplating, and are satisfactory for this purpose. The amount of zinc deposited by zincating procedures as heretofore known, however, is inadequate in at least many instances to provide the requisite supply of zinc for subsequent diffusion to protect an aluminum article effectively against pitting corrosion; that is to say, the layer of zinc thus applied is insufficient to diffuse to the required depth (when the coating article is heated) and to provide the required zinc concentration at the aluminum surface after diffusion, for satisfactory corrosion protection. A typical zinc deposit produced by conventional zincating may diffuse only to a depth of about 60 microns and provide a zinc concentration at the surface as low as 0.2–0.5% by weight. Furthermore, even if it is attempted to achieve a heavier coating of zinc with conventional zincating procedures as by extending the treatment period, the time required to develop a desired amount of deposition (e.g. 10 grams per square meter or more) is uneconomically protracted, being typically as much as 30 minutes or even longer; the results obtained with given conditions are not reliably reproducible; and the produced coatings tend to be very uneven and/or so poorly adherent to the aluminum surface that substantial amounts of the coating material may become lost during handling prior to heating for diffusion. Consequently, notwithstanding the simplicity and convenience of zincating procedures, they have had serious drawbacks for such purposes as depositing zinc for subsequent diffusion for corrosion protection.

SUMMARY OF THE INVENTION

The present invention broadly contemplates the provision of a two-stage zincating process for depositing zinc on an aluminum surface, wherein the surface is initially exposed to a zincate bath under relatively weak zinc-depositing conditions and then exposed to a zincate bath under stronger zinc-depositing conditions, the terms "weak" and "stronger" referring to rate of deposition of zinc on an aluminum surface in a given surface condition as hereinafter further defined. In accordance with the invention, stronger zinc-depositing conditions are achieved (increasing the rate of deposition) by decreasing the concentration of zinc oxide in the zincate bath and/or by increasing the bath temperature. It is found that this two-stage process enables facile, economical, and reliably reproducible attainment, within a total treatment time of only a few minutes, of an advantageously uniform and strongly adherent zinc deposit of desired weight, up to as much as about 20 grams per square meter, that is in all respects fully adequate for such purposes as the type of corrosion protection (establishment of a zinc-enriched protective layer by diffusion) described above.

More particularly, the present invention contemplates the provision of a process for applying a coating of zinc to a surface of an aluminum article comprising the steps of, first, exposing the surface to an aqueous bath, containing an alkali metal hydroxide and a concentration of zinc oxide between about 50 and about 110 grams per liter, at a temperature between about 20° and about 40° C. for depositing metallic zinc on the surface;

and, second, exposing the surface, bearing the zinc deposited thereon in the first step to an aqueous bath containing an alkali metal hydroxide and a concentration of zinc oxide between about 30 and about 70 grams per liter, at a temperature between about 30° and about 60° C. for depositing further metallic zinc on the surface, the last-mentioned zinc oxide concentration and the last-mentioned temperature being mutually selected to provide a stronger deposition condition in this second step than in the first step.

In this process, at the outset of the first step the surface to be coated has some localities that are more active for zinc deposition than are other localities of the surface. Activity for zinc deposition, as used herein, refers to activity with respect to the displacement reaction whereby aluminum ions replace zinc ions in the solution, and zinc is deposited; thus, under any given zinc depositing condition (weak or strong), deposition occurs preferentially at more active sites or localities. Further in accordance with the invention, the first step of the present process effects deposition of zinc preferentially in the more active localities of the aluminum surface while leaving the other (less active) localities of the surface at least substantially free of zinc, and the second step effects deposition of zinc in those other localities.

For full realization of the advantages of the invention, process conditions are selected so that the amount of zinc deposited in the first step is between about 10% and about 70% by weight (very preferably between about 25% and about 55% by weight) of the total amount of zinc deposited in both steps. It is preferred that the overall weight of zinc deposited be between about 5 and about 20 grams per square meter of surface area, and that the weight of zinc deposited in the first step be between about 2 and about 7 (most preferably at least about 3) grams per square meter. In this regard, it is preferred that the period of exposure of the surface to the bath in the first step be not more than about two minutes, such being amply adequate to achieve a first-step deposit of zinc within the above-specified ranges.

As will be understood, the rate of deposition in the first step may be very rapid at the outset, notwithstanding that the first-step conditions are "weaker" than the second-step conditions, because of the initial availability of the most active sites or localities on the aluminum surface. After these sites have been occupied by first-step zinc deposition (ordinarily within a period of at most about a minute and a half), however, the rate of first-step deposition becomes very slow. At this point, the second-step deposition conditions provide a very significantly faster rate of deposition than the first-step deposition conditions, i.e. if the first step were continued; and it is in this sense that the "stronger" conditions of the second step are defined as providing a more rapid rate of zinc deposition than the "weak" first-step conditions, viz. because the second-step conditions are selected to provide a more rapid deposition of zinc than would be achieved by continued treatment in the bath of the first step, even though the initial deposition rate at the outset of the first step may exceed the deposition rate in the second step.

As a still further particular feature of the invention, the second-step conditions are made "stronger" (with respect to zinc deposition) than the first-step conditions by utilizing a second-step bath wherein the concentration of zinc oxide is at least about 10 grams per liter lower (preferably at least about 20 grams per liter lower), and/or wherein the temperature is at least about 5° C. higher (preferably at least about 10° C. higher) than in the first-step bath, or by some corresponding combination of altered zinc oxide concentration and bath temperature. In both steps, a useful or practicable range of alkali metal hydroxide (sodium hydroxide being conveniently suitable) is between about 200 and about 550 (preferably between about 300 and about 500) grams per liter, expressed as sodium hydroxide.

The aluminum surface to be coated should be degreased prior to performance of the first step, but this degreasing should be performed (conveniently, by application of an organic solvent) without substantially enhancing the activity of the surface for zinc deposition (i.e. apart from the removal of overlying material such as oil stains and/or fine powders, which would block deposition), in contrast to the conventional prior practice of activating the surface with an alkali or other activating step before zincating treatment.

In instances where the zinc deposited by the present process is used for corrosion-preventing purposes, the coated article (after the second step) is heated, with the applied zinc coating adhering to its surface, to a temperature below the melting point of the article for effecting diffusion of zinc from the surface coating into a region of the article adjacent the surface.

Further features and advantages of the invention will be apparent from the detailed description hereinbelow set forth, together with the accompanying drawing.

BRIEF DESCRIPTION OF THE DRAWING

The single FIGURE is a rectangular-coordinate graph, having an x-axis representing temperature (in °C.) and a y-axis representing the zinc oxide concentration in grams per liter, illustrating relationships between these conditions in the two steps of the present process.

DETAILED DESCRIPTION

The process of the invention will be described with reference to the coating of one or more surfaces of an aluminum article with zinc by two successive steps of exposure, of the surface or surfaces to be coated, to alkaline zincate solutions. The manner of such exposure may be conventional, as will be well understood by persons of ordinary skill in the art; for example, the article may be immersed in the bath, and any surfaces which are not to be coated (e.g. the interior of a tube) are masked or blocked off so that only the surfaces which are to be coated are brought into contact with the bath.

Prior to the first step, the surface or surfaces to be coated are degreased (for removal of fine powders and/or oil stains which would interfere with satisfactory zinc deposition) but without substantially enhancing the activity of the surface or surfaces for zinc deposition. Conveniently or preferably, degreasing is effected with an organic solvent such as trichlorethylene, perchloroethylene, trichloroethane, or "Fron 113"; in any event, use of alkali, acid, or other activating treatment is avoided.

The first step of the process, in this described embodiment, involves exposing the aluminum article surface to be coated to an aqueous solution containing alkali metal hydroxide (preferably or conveniently NaOH) and zinc oxide under relatively weak zinc-depositing conditions, to effect preferential deposit of zinc on the localities of the surface which are most active for zinc deposition. This initial deposit of zinc inhibits or limits continuing reaction at these most active sites, thus preventing excessive removal of aluminum therefrom. Then, while localities of the aluminum surface which are less active for zinc deposition remain at least substantially free of deposited zinc, the aluminum surface bearing the initial (first-step) zinc deposit is subjected to the second step of the process by exposure to an aqueous solution containing alkali metal hydroxide (e.g. NaOH) and ZnO under stronger zinc-depositing conditions to effect deposit of zinc in those other localities of the surface of the aluminum article at which zinc was substantially not deposited in the first step.

In the first step, the amount of zinc deposition is preferably about 2–7 g/m$^2$ (most preferably about 3–7 g/m$^2$) with grain sizes of about 0.5 to about 7 microns. In the second step, wherein the ZnO concentration is reduced and/or the temperature of the solution is made higher than in the first step, further zinc grains are deposited in locations adjacent the zinc grains deposited in the first step, to provide an overall amount of zinc deposition between about 5 and about 20 g/m$^2$. The amount of zinc deposition in the first step is about 10% to about 70% by weight, preferably above 25% to about 55% by weight, of the total amount deposited in the two steps. If more than about 55% of the total is deposited in the first step, the rate of zinc deposition in the second step is reduced.

A suitable range of hydroxide (preferably NaOH) concentrations for the bath in each step is about 200 to about 550 g/l, calculated as NaOH, and preferably about 300 to about 500 g/l. In the first step, to provide "weak" deposition conditions, the ZnO concentration is between about 50 and about 110 g/l, and the bath temperature is about 20° to about 40° C. In the second step, to provide "strong" deposition conditions, the ZnO concentration is between about 30 and about 70 g/l, and the bath temperature is about 30° to about 60° C. To provide the requisite "strong" conditions in the second step, the ZnO concentration is made lower in the second step than in the first step and/or the temperature is made higher in the second step than in the first step, since reduction in ZnO concentration and increase in bath temperature both tend to increase rate of zinc deposition, other factors being equal, throughout the ranges herein contemplated.

The relationship between the conditions in the respective steps may be further elucidated by reference to the drawing, wherein temperature (in °C.) is plotted on the x-axis and ZnO concentration (in g/l) is plotted on the y-axis. The rectangle ABCD represents the "weak" conditions (20°–40° C., 50–110 g/l ZnO) of the first step of the present process, while the rectangle EFGH represents the "strong" conditions (30°–60° C., 30–70 g/l ZnO) of the second step. Any point on the graph represents a unique combination of bath temperature and ZnO concentration.

It will be seen that there is an area of overlap (rectangle EKCJ) between the weak conditions of the first step and the strong conditions of the second step; and that, more generally, both the temperature ranges and the ZnO concentration ranges of the two steps overlap. In addition to the requirement that the first-step conditions be represented by a point within rectangle ABCD and that the second-step conditions be represented by a point within rectangle EFGH, then, there is the additional requirement that the second-step conditions be selected to be stronger than the first-step conditions. For example, it is possible to use the same solution for both steps, i.e. having the same ZnO concentration, if the latter concentration is within the common range of 50–70 g/l, provided that the second-step temperature is higher than the first-step temperature; in such case, referred to as the "single-solution" case, the second-step temperature is preferably at least about 5° C. higher (most preferably at least about 10° C. higher) than the first-step temperature. Conversely, if the same temperature (within the common range of 30°–40° C.) is used for both steps, the second-step ZnO concentration is preferably at least about 10 g/l less (most preferably at least about 20 g/l less) than the first-step concentration.

More generally, to assure that the second-step conditions are stronger than the first-step conditions, it is preferred that for any given first-step temperature and ZnO concentration respectively designated $x_o$ and $y_o$ on the aforementioned graph, the second-step conditions are so selected that the point representing the second-step temperature and ZnO concentration on the graph lies to the right of a line $S_o$ defined by the points $(x_o+5, y_o)$ and $(x_o, y_o-10)$. Thus, for the exemplary point $x_o$, $y_o$ shown on the graph (representing the first-step conditions of temperature 33.75° C., ZnO concentration 61.25 g/l), the second-step concentration and temperature should be such as to be represented by a point within the portion of rectangle EFGH lying to the right of the illustrated line $S_o$, or in other words, by a point within the pentagonal figure MFGHL (M and L being respectively the intercepts of line $S_o$ with lines EF and EH). On the other hand, if the first-step conditions are those represented by point $x_o'$, $y_o'$ on the graph (30° C., 100 g/l ZnO), the second-step conditions may be anywhere within rectangle EFGH, because the entire rectangle EFGH lies to the right of line $S_o'$ corresponding to point $x_o'$, $y_o'$.

As described above, even though weak deposition conditions are employed in the first step (providing a relatively low deposition rate for any given surface condition), aluminum may easily react causing zinc deposition in active loci on the aluminum surface, e.g. strained positions of crystals, grain boundaries, etc. Therefore, during the first step, suitable initial zinc deposition can be obtained even under very weak conditions. The amount of first-step zinc deposition increases at the outset on a relatively steep curve depending on the processing time, but reaches substantial saturation in about 1 to 2 minutes. In this case, the amount of first-step zinc deposition is several grams per square meter. The zinc grains deposited on the surface of the aluminum article in the first step have relatively large grain sizes, although they are smaller than 7 microns; relatively few grains are deposited, distributed in the more active localities of the surface.

In the second step, zinc is to be deposited on the less active localities of the aluminum article which remain substantially zinc-free after the first step, and, as stated, more aggressive (stronger) deposition conditions are employed in the second step, providing a higher rate of deposition. In this second step, the amount of zinc deposition increases gradually and linearly, the extent of deposition being dependent on the processing time, because there are a large number of nuclei of deposition and the growth of each nucleus is slow; the deposited fine zinc grains of the second step densely cover the spaces between the relatively large zinc grains previously deposited in the first step.

In the present process, degreasing is performed without NaOH or other activation or etching because such activation or etching pretreatment tends to produce erratic, uneven or varying results even though other conditions are held constant. Moreover, activating or etching pretreatment (e.g. with NaOH) alters the surface condition of the aluminum article in such manner that after a short period of exposure to zincate solution, zinc grains are deposited covering all the surface of the aluminum article, inhibiting subsequent zinc-depositing reaction with the aluminum article surface. Thus, under typical second-step zinc-depositing conditions (e.g. exposure to a solution containing 60 g/l ZnO and 350 g/l NaOH at 30° C. for 5 minutes), it became difficult to obtain a large amount of zinc deposition such as expected.

Following the two-step zinc-depositing treatment of the present process, the aluminum article can be heated to effect diffusion of zinc from the coated surface into the adjacent region of the article to produce a zinc-enriched layer for protecting the article against pitting corrosion. To this end, for example, the article may be heated to a temperature of 590°–610° C. for 2 minutes. This treatment modifies the surface-adjacent region of the aluminum article to provide a zinc concentration of 1–7 at the surface, and a diffusion layer 50–150 microns deep, with the levels of zinc deposited by the present process.

The process of the present invention is characterized in that zinc is first deposited on the most active loci of an aluminum article surface under weak deposition conditions with a transverse grain diameter of less than 7 microns (and a thickness of deposit of about 1–2 microns), and strong deposition conditions are then applied to effect deposit of zinc on the remaining, less active portions of the surface. In prior practice, treatment times ranging upward of 30 minutes have been required to deposit a large amount of zinc using conventional zincating procedures. Also, in such prior practice, deposited zinc grains often dropped off the surface during diffusion treatment, thus resulting in poor yield. In the present invention, the zincating treatment is performed in two stages, preventing abnormal deposition while enabling attainment of an advantageously heavy zinc deposit having good crystallinity in a short time. For instance, the first step of the present method may be performed in about 1.5 minutes and the second step in about 5 minutes, although these times will depend on the amount of zinc needed and hence (in the case of corrosion-preventing applications as described above) on the degree of expected corrosion resistivity. The aluminum article obtained with the present process, after coating and diffusion of zinc, has a high zinc concentration on the surface and a diffusion depth of Zn which is suitable to provide the requisite cathodic protection. In the present coating process, fine zinc grains (in the second step) are deposited on and cover the spaces around the relatively large, previously deposited (first step) zinc grains, thus providing a zinc surface of excellent crystallinity. Accordingly, the manufactured zinc layer can withstand heat treatment for zinc diffusion, because it has good adherence to the coated surface, as one of the advantages of the present invention.

Usually or preferably, the surface is exposed to the first-step bath for a period of not more than about two minutes, the rate of zinc deposition in the first step being so slow by that time as to make further continuation of that step uneconomical. When (as is ordinarily the case) the article being coated is transferred from the first-step bath to the second-step bath, the transfer is effected without washing or otherwise treating the coated surface between the two steps.

By way of further illustration of the invention, reference may be made to the following specific examples:

EXAMPLE 1

A flat aluminum tube for use in an automobile air conditioner condenser, 26 mm. wide, 5 mm. high and 6 meters in length when fully extended), bent in serpentine form, was degreased with trichloroethylene vapor and subjected to a two-step zincating treatment in accordance with the present invention. In the first step, the tube was immersed for 1.5 minutes in an aqueous bath containing 100 g/l ZnO and 350 g/l NaOH, at a bath temperature of 30° C.; by this treatment, a zinc deposition layer of 5.1 g/m$^2$ was obtained. After drying, but without passing through water washing, the tube was immersed for 5.0 minutes in the second-step aqueous bath, which contained 60 g/l ZnO and 350 g/l NaOH, at a bath temperature of 50° C. At the end of the second step the tube surface bore a uniform coating of zinc, in an amount of 13.0 g/m$^2$, exhibiting excellent adherence to the surface.

The coated tube was then joined to aluminum fins by brazing in a conventional manner, viz. by heating at 600° C. for two minutes, in the presence of a flux of the type described in the aforementioned U.S. Pat. No. 3,951,328, a slurry of the flux being sprayed on the assembly before brazing. As a result of the brazing (heating) step, the zinc diffused into the region of the tube adjacent the zinc-coated surface to provide a surface-adjacent zinc-enriched (diffusion) layer having excellent characteristics for cathodic protection of the tube. The diffusion depth was 100 to 130 microns and the zinc concentration at the surface was 4 to 5% by weight.

EXAMPLE 2

The zinc-coating procedure of Example 1 was repeated with similar aluminum tubes, except that the period of immersion in the second-step bath was varied, different second-step immersion times being used for different samples. Results are given in Table A.

TABLE A

| Time of second-step immersion (minutes) | Amount of net zinc deposition in second step (g/m$^2$) |
|---|---|
| 1 | 1.8 |
| 2 | 2.9 |
| 3 | 4.7 |
| 4 | 6.3 |
| 5 | 7.9 |
| 6 | 9.8 |
| 7 | 11.3 |
| 8 | 12.9 |
| 9 | 14.5 |
| 10 | 16.4 |

In this example, again, substantially uniform zinc coatings were produced. As Table A indicates, the amount of net zinc deposition in the second step increased substantially linearly with immersion time.

EXAMPLE 3

A rolled sheet of AA 1050 aluminum alloy, 50 mm.×50 mm.×1 mm. thick, was degreased with trichloroethylene vapor. A plurality of samples were subjected to two-step zincating treatments in accordance with the invention. The first step aqueous bath, containing 100 g/l ZnO and 350 g/l NaOH, was at a temperature of 30° C.; first-step immersion time was 1.5 minutes. The second-step aqueous bath, containing 60 g/l ZnO and 350 g/l NaOH, was at a temperature of 50° C.; various second-step immersion times were used with different samples, all of which were otherwise treated identically. Total immersion times (first+second step) and total amounts of zinc deposition are given in Table B. Once more, the two-step treatments produced substantially uniform coatings of zinc.

TABLE B

| Step(s) | Total immersion time (min.) | Total zinc deposited (g/m$^2$) |
|---|---|---|
| first step only | 1.5 | 5.5 |
| first + second steps | 2.5 | 7.4 |
| " | 3.5 | 8.3 |
| " | 4.5 | 9.6 |
| " | 5.5 | 11.4 |
| " | 6.5 | 12.0 |
| " | 7.5 | 14.3 |
| " | 8.5 | 15.9 |
| " | 9.5 | 18.7 |
| " | 10.5 | 19.4 |
| " | 11.5 | 20.6 |

EXAMPLE 4

An extruded flat tube of AA 1050 aluminum alloy, 26 mm. wide, 5 mm. high, and 400 mm. long, was degreased with trichloroethylene vapor, and samples were subjected to two-step zincating treatments in accordance with the invention. Three series of tests were run, with the following aqueous baths:

| Test Series | ZnO conc. (g/l) first step | ZnO conc. (g/l) second step |
|---|---|---|
| I | 60 | 35 |
| II | 70 | 60 |
| III | 60 | 60 |

All baths contained 350 g/l NaOH; also, all first-step bath temperatures were 30° C., all first-step immersion times were 1.5 minutes, and all total (first+second) step immersion times were 6.5 minutes. Second-step temperatures were varied. Results (total, i.e. first+second step, zinc deposition) are given in Table C. It will be seen that test series III was a "single solution" procedure (same bath composition used in both steps, but at a higher temperature in the second step) while test series I and II were "two-solution" procedures. As before, in all three test series the two-step process produced heavy and substantially uniform zinc deposits in short (6.5 minutes) total immersion time periods.

TABLE C

| Test Series | Steps Performed | Second Step Temp. (°C.) | Total Zinc Deposited (g/m$^2$) |
|---|---|---|---|
| I | 1st only | — | 3.1 |
| | 1st + 2nd | 40 | 13.6 |
| | 1st + 2nd | 45 | 16.8 |
| II | 1st only | — | 2.6 |
| | 1st + 2nd | 45 | 8.5 |
| | 1st + 2nd | 50 | 11.5 |
| | 1st + 2nd | 55 | 13.5 |
| III | 1st only | — | 3.2 |
| | 1st + 2nd | 50 | 8.5 |
| | 1st + 2nd | 60 | 11.8 |

EXAMPLE 5

For purposes of comparison, another 400 mm. length of the same (26 mm. wide, 5 mm. high) tube used in Examples 1 and 2 above was degreased with trichloroethylene vapor and, without being alkali-etched, was subjected to an ordinary (one-step) zincating treatment, in an aqueous bath containing 60 g/l ZnO and 350 g/l NaOH. With a bath temperature of 20° C., an exceptionally long (20 min.) immersion time resulted in a zinc deposit of 12.2 g/m$^2$, and some of the deposited zinc was easily rubbed off (i.e. when the deposit was rubbed with a finger). In a second one-step test, a sample of the same tube (again degreased but not etched, as above) was immersed in the same bath but at a bath temperature of 45° C., with an immersion time of 2.0 minutes; localized zinc deposition occurred, and the deposit was easily removable.

Thus, in the one-step process, the higher bath temperature resulted in abnormal deposition, and with the low-temperature operation a long time was required to produce 12 g/m$^2$ or more of deposited zinc. In addition, at least portions of the deposits were easily removable.

EXAMPLE 6

As a further comparison, samples (designated X) of the same flat tube used in Examples 1, 2, and 5, and samples (designated Y) of another flat aluminum tube of the same dimensions but made by another manufacturer, were degreased with trichloroethylene, alkali-etched with a 50 g/l NaOH solution at 50° C. for 1.5 minutes, and treated by ordinary (one-step) zincating procedures. Treatment conditions and results–are set forth in Table D. All solutions contained 350 g/l NaOH, and the indicated concentrations of ZnO.

TABLE D

| Sample | ZnO conc. (g/l) | bath temp. (°C.) | immersion time (min.) | zinc deposited (g/m$^2$) | Surface condition |
|---|---|---|---|---|---|
| X | 35 | 55 | 5 | 11.8 | good |
| Y | 35 | 55 | 5 | 2.5 | good |
| X | 60 | 60 | 5 | 3.5 | good |
| Y | 25 | 55 | 2 | — | abnormal* |

*localized zinc deposition, easily peeled off

As Table D indicates, the described surface conditioning pretreatment tends to produce widely varying amounts of zinc deposition (or, under conditions providing a high rate of deposition, abnormal deposition) because of differences in the displacement-reaction behavior of products of different manufacturers even where the same conditions of solutions, and samples of the same alloy and dimensions, are employed.

It is to be understood that the invention is not limited to the procedures and embodiments hereinabove specifically set forth, but may be carried out in other ways without departure from its spirit.

We claim:

1. A process for applying a coating of zinc to a surface of an aluminum article comprising, in combination, the steps of (a) exposing the surface to an aqueous bath, containing an alkali metal hydroxide and a concentration of zinc oxide between about 50 and about 110 grams per liter, at a temperature between about 20° and about 40° C. for depositing metallic zinc on said surface; and (b) exposing the surface, bearing the zinc deposited thereon in step (a), to an aqueous bath, containing an alkali metal hydroxide and a concentration of zinc oxide between about 30 and about 70 grams per liter, at a temperature between about 30° and about 60° C. for depositing further metallic zinc on said surface, the last-mentioned zinc oxide concentration and the last-mentioned temperature being mutually selected to provide a stronger deposition condition in this step (b) than in step (a).

2. A process according to claim 1, wherein the total amount of zinc deposited in steps (a) and (b) is between about 5 and about 20 grams per square meter of surface area.

3. A process according to claim 2, wherein the amount of zinc deposited in step (a) is between about 2 and about 7 grams per square meter of surface area.

4. A process according to claim 3, wherein the amount of zinc deposited in step (a) is at least about 3 grams per square meter of surface area.

5. A process according to claim 1, wherein the amount of zinc deposited in step (a), in grams per square meter of surface area, is between about 10% and about 70% of the total amount of zinc deposited in steps (a) and (b).

6. A process according to claim 1, wherein the amount of zinc deposited in step (a), in grams per square meter of surface area, is between about 25% and about 55% of the total amount of zinc deposited in steps (a) and (b).

7. A process according to claim 1, wherein at the outset of step (a) said surface has some localities that are more active for zinc deposition than are other localities of said surface, wherein step (a) effects deposition of zinc preferentially in said more active localities while leaving said other localities at least substantially free of zinc, and wherein step (b) effects deposition of zinc in said other localities.

8. A process according to claim 1, wherein the surface is exposed to the first-mentioned bath, in step (a), for a period of not more than about two minutes.

9. A process according to claim 1, wherein each of said baths contains alkali metal hydroxide in a concentration between about 200 and about 550 grams per liter (calculated as NaOH).

10. A process according to claim 9, wherein said hydroxide is sodium hydroxide and is present in each of said baths in a concentration between about 300 and about 500 grams per liter.

11. A process according to claim 1, wherein the temperature of the bath in step (b) is at least about 5° C. higher than the temperature of the bath in step (a).

12. A process according to claim 11, wherein the temperature of the bath in step (b) is at least about 10° C. higher than the temperature of the bath in step (a).

13. A process according to claim 1, wherein the concentration of zinc oxide in the bath in step (a) is at least about 10 grams per liter higher than the concentration of zinc oxide in the bath in step (b).

14. A process according to claim 13, wherein the concentration of zinc oxide in the bath in step (a) is at least about 20 grams per liter higher than the concentration of zinc oxide in the bath in step (b).

15. A process according to claim 1, including the step of degreasing the surface prior to step (a) without substantially enhancing the activity of the surface for zinc deposition.

16. A method as defined in claim 1, wherein the step (b) temperature and ZnO concentration are selected such that on a rectangular-coordinate graph having an x-axis representing temperature in degrees centigrade and a y-axis representing ZnO concentration in grams per liter with the step (a) temperature and ZnO concentration respectively designated $x_o$ and $y_o$, the point representing the step (b) temperature and ZnO concentration lies to the right of a line defined by the points $(x_o+5, y_o)$ and $(x_o, y_o-10)$.

17. A process for establishing, adjacent a surface of an aluminum article, a zinc-enriched layer of said article effective to protect the surface against corrosion, comprising, in combination, the steps of (a) applying an adherent coating of zinc to said surface by (i) exposing the surface to an aqueous bath, containing an alkali metal hydroxide and a concentration of zinc oxide between about 50 and about 110 grams per liter, at a temperature between about 20° and about 40° C. for depositing metallic zinc on said surface; and (ii) exposing the surface, bearing the zinc deposited thereon in step (i), to an aqueous bath, containing an alkali metal hydroxide and a concentration of zinc oxide between about 30 and about 70 grams per liter, at a temperature between about 30° and about 60° C. for depositing further metallic zinc on said surface, the last-mentioned zinc oxide concentration and the last-mentioned temperature being mutually selected to provide a stronger deposition condition in this step (ii) than in step (i); and (b) heating the article, with the applied zinc coating adherent to said surface, to a temperature below the melting point of the article for effecting diffusion of zinc from the surface coating into a region of the article adjacent the surface.

* * * * *